United States Patent [19]

Aotsuka

[11] 4,165,236

[45] Aug. 21, 1979

[54] COLOR PHOTOGRAPHIC LIGHT-SENSITIVE MATERIAL

[75] Inventor: Yasuo Aotsuka, Minami-ashigara, Japan

[73] Assignee: Fuji Photo Film Co., Ltd., Minami-ashigara, Japan

[21] Appl. No.: 735,654

[22] Filed: Oct. 26, 1976

Related U.S. Application Data

[63] Continuation of Ser. No. 523,176, Nov. 12, 1974, abandoned.

[30] Foreign Application Priority Data

Nov. 12, 1973 [JP] Japan ..... 48/127083

[51] Int. Cl.[2] ..... G03C 1/76; G03C 7/00; G03C 7/04

[52] U.S. Cl. ..... 96/74; 96/2; 96/7

[58] Field of Search ..... 96/74, 2, 7, 8

[56] References Cited

U.S. PATENT DOCUMENTS

| | | | |
|---|---|---|---|
| 2,360,214 | 10/1944 | Evans et al. | 96/2 |
| 3,516,831 | 6/1970 | Wolf et al. | 96/74 |
| 3,990,898 | 11/1976 | Land | 96/74 |

FOREIGN PATENT DOCUMENTS

| | | | |
|---|---|---|---|
| 923045 | 4/1965 | United Kingdom | 96/74 |

*Primary Examiner*—Dennis E. Talbert, Jr.
*Assistant Examiner*—Louis Falasco
*Attorney, Agent, or Firm*—Sughrue, Rothwell, Mion, Zinn and MacPeak

[57] ABSTRACT

A color photographic light-sensitive material which comprises a support having thereon at least a red-sensitive silver halide emulsion layer, a green-sensitive silver halide emulsion layer, a yellow filter layer and a blue-sensitive silver halide emulsion layer, the red-sensitive silver halide emulsion layer being positioned farther from the support than the yellow filter layer.

11 Claims, 5 Drawing Figures

COLOR PHOTOGRAPHIC LIGHT-SENSITIVE MATERIAL

This is a continuation of application Ser. No. 523,176 filed Nov. 12, 1974 now abandoned.

BACKGROUND OF THE INVENTION

1. Field of the Invention

The present invention relates to a color light-sensitive material for use in photography, in which less deterioration in color balance in the case of photographing under different kinds of light sources occurs. More particularly, it is concerned with a color light-sensitive material for tungsten light, in which an extremely small deterioration in color balance in the case of photographing under a fluorescent lamp occurs.

2. Description of the Prior Art

Color films are used to take pictures under various light sources. However, the color balance of a color film, which is designed so that the best color balance can be obtained in photographing under a specific light source, is deteriorated when photographing using a different light source. This results from the difference in the distribution of light energy of the light sources versus wavelength. This also arises from the difference in color temperature of the light sources.

In recent years, color films have been widely used by amateurs. However, the photographing conditions vary widely. They are used under sunlight, tungsten lamp light or under fluorescent lamp light, alone or in combination. Since this color temperature of sunlight is very different from the color temperature of tungsten light, disadvantages occur when a color film which is designed to be the most suitable for photographing under a tungsten lamp light source (generally referred to as a tungsten-type color film) is photographed under sunlight. For example, the resulting positive image becomes bluish.

Whether the color balance when photographed under tungsten light source is strictly correct or not can be judged by photgraphing a neutral gray substance (a substance whose spectral reflectance or percent transmission is at a specific level over the entire visible wavelength region) under a tungsten light source and examining whether or not the position of the reproduced color on CIE standard chromaticity diagram (see *Theory of Color Reproduction,* pp. 10–26 and 160–162, translated by Tsutomu Mato and Taturo Kuniji, and published by Printing Society, 1971) coincides with the point corresponding to tungsten light on CIE standard chromaticity diagram.

In the case of photographing under mixture of light of a fluoroscent lamp and a tungsten lamp or under a fluorescent lamp light source, the color balance of tungsten-type color film is deteriorated and the value of the image is reduced.

In order to solve this problem, (1) a method of using light-sensitive materials appropriately designed to be suitable for different color temperatures and (2) a method of using a filter capable of converting the color temperature are known. For method (1), specifically, two types of light-sensitive materials have been manufactured for a long time: one type being for sunlight (referred to as a light-sensitive material for fluorescent color); and the other type being for a tungsten light source (referred to as a light-sensitive material for tungsten light). However, at the present stage since fluorescent lamps having various light characteristics exist and have been used even in comparison with a tungsten lamp, it is actually impossible to further increase the kinds of light-sensitive materials for proper use. Further, for method (2), although a large number of different kinds of filters can be used, the procedures of measuring the color temperature of a light source, selecting a suitable filter and attaching the filter to a lens are troublesome, and artificial errors such as incorrect selection of a filter and forgetting to employ the filter, and the like can not completely be prevented. As a countermeasure therefor, the incorporation of a mechanism for automatically converting the color temperature in a camera could be considered. However, such mechanism has the defect that the camera is large, complicated and expensive. An ideal method is to impart such characteristics to a color light-sensitive material itself so that it is not affected, or is affected only slighly, by a change in the color temperature of light source.

Some commercial products aiming at this effect are the reversal color films sold under the trade name of "Fujichrome RT 200" ("Fuji" being a registered trademark of Fuji Photo Film Co., Ltd.), and the like. In these products, the light-sensitive region of a red-sensitive layer is set on the shorter wavelength side as compared with ordinary color light-sensitive materials, the peak of optical sensitivity lying between 605 mμ and 640 mμ(usually set not shorter than 650 mμ). Although these light-sensitive materials are designed for tungsten light, their color balance is deteriorated less under fluorescent light as compared with ordinary color films. On the other hand, however, it is difficult with these light-sensitive materials to maintain the sensitivity level of the red-sensitive layer under a tungsten light source, because the light amount of red light component contained in tungsten light is decreased along the shorter wavelength side. This is because the amount of the red light component of tungsten light is decreased along the shorter wavelength side. Therefore, in order to maintain color balance under a tungsten light source, the sensitivity of the red-sensitive layer must be increased. However, where the size of the silver halide grains are increased to raise the sensitivity, the defect that the graininess of the red-sensitive layer is deteriorated occurs. Since graininess is one of the important elements for evaluating the image quality, the above-described defect is serious.

SUMMARY OF THE INVENTION

An object of the present invention is to provide a new type color light-sensitive material in which the color balance due to the difference in color temperature is deteriorated to a lesser extent.

Another object of the present invention is to provide a tungsten type color film in which the color balance is deteriorated less even when photographed under a fluorescent lamp light source.

A further object of thepresent invention is to provide a color light-sensitive material having improved graininess.

It has now been found that the above-described objects of the invention can effectively be attained in a usual color light-sensitive material for use in photographing in which the stratum configuration comprises a support having thereon at least a red-sensitive siver halide emulsion layer, a green-sensitive silver halide emulsion layer, a yellow filter layer and a blue-sensitive silver halide emulsion layer, so that (1) the entire red-sensitive silver halide emulsion layer is positioned farther from the support than the yellow filter layer; or (2) when the red-sensitive silver halide emulsion layer comprises a first red-sensitive silver halide emulsion layer and a second red-sensitive silver halide emulsion layer, the second red-sensitive silver halide emulsion layer is positioned farther from the support than the yellow filter layer.

In the figures, S designates a support, BL a blue-sensitive layer, GL a green-sensitive layer, $GL_1$ a first green-sensitive layer, $GL_2$ a second green-sensitive layer, RL a red-sensitive layer, $RL_1$ a first red-sensitive layer, $RL_2$ a second red-sensitive layer, PC a protective layer and YF a yellow filter layer.

DETAILED DESCRIPTION OF THE INVENTION

The invention will be explained in detail by reference to the accompanying drawings.

Figure 1:
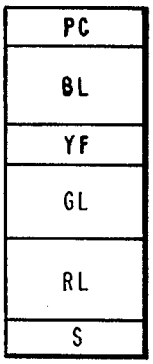
FIG. 1 shows a schematic view of the stratum configuration of conventionally known color photographic light-sensitive materials for use in photography, in which only the layers necessary for the explanation of the present invention are shown.

FIG. 1 shows a stratum structure of ordinary color light-sensitive materials comprising a support having thereon, in sequence, a red-sensitive silver halide emulsion layer (RL), a green-sensitive silver halide emulsion layer (GL), a yellow filter (YF), a blue-sensitive silver halide emulsion layer (BL) and a protective layer (PC) at the outermost side.

Figure 2:
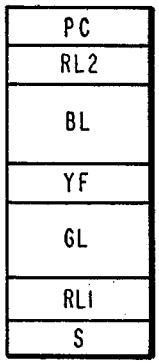
FIGS. 2, 3, 4 and 5 show schematic views of the stratum configuration of the color photographic light-sensitive materials of the present invention for use in photography, in which only the layers necessary for the explanation of the present invention are shown.
Figure 3:
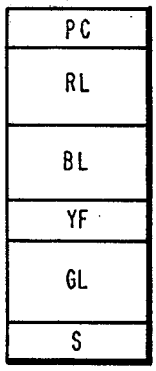
Figure 4:
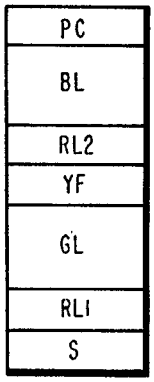
Figure 5:
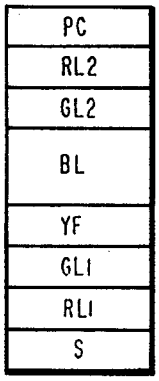

FIGS. 2 to 5 show specific examples of the present invention, in which a part or all of the RL is positioned on the opposite side to the support with respect to the YF. In FIG. 2, a part of the RL (the second red-sensitive layer) is positioned on the BL while, in FIG. 3, all of the RL is provided on the BL. FIG. 4 shows an example wherein a part of the RL (the second red-sensitive layer) is positioned between the BL and the YF. FIG. 5 shows the example wherein a part of the GL (the second green-sensitive layer) as well as part of the RL is positioned on the YF. Additionally, FIGS. 1 to 5 show only the layers necessary for explaining the present invention. In practicising the present invention, other layers such as a subbing layer, an anti-halation layer, an interlayer, and the like can be employed as desired.

With conventional color light-sensitive materials for use in photography, it is common knowledge to provide a yellow filter on a green-sensitive layer and a red-sensitive layer in order that the intrinsic light-sensitive region for silver halide is utilized for the blue-sensitive layer (or yellow-coloring layer) and that the green-sensitive layer (or magneta-coloring layer) and the red-sensitive layer (or cyan-coloring layer) which are optically sensitized, respectively, to 500–600 mμ and 600–700 mμ with suitable spectrally sensitizing dyes, are intercepted from blue light to which the silver halide is sensitive. In the present invention, however, a part or all of the red-sensitive layer is provided on the yellow filter (i.e., on the side of the yellow filter layer opposite to the support) in order to render it sensitive, in contrast with the above-described common knowledge.

In comparing the light from a fluorescent lamp with the light from a tungsten lamp where the light amount of the green light component is equal reveals that the light from the fluorescent lamp contains more blue light component and less red light component as compared with light from the tungsten lamp. Therefore, when an ordinary light-sensitive material balanced for tungsten light is exposed using light from a fluorescent lamp, the red light component is insufficient (in other words, the sensitivity of the red-sensitive layer is apparently reduced), whereas the blue light component is excessive (in other words, the sensitivity of the blue-sensitive layer is apparently increased). As a result, for example, when a color film for tungsten light is exposed using light from a fluorescent lamp, the resulting color image is tinged with cyan blue.

The composition and properties of the emulsion of the red-sensitive layer positioned on (or above) the yellow filter layer can be different from those of the red-sensitive layer positioned below the yellow filter layer (the latter being the red-sensitive layer provided in ordinary color photographic sensitive materials). The properties of the emulsions should be decided such that good overall color balance of the layers is achieved. In general, the red-sensitive layer positioned on (or above) the yellow filter layer can be less sensitive as compared with the sensitivity of the red-sensitive layer positioned below the yellow filter layer of ordinary color photographic materials. Therefore, a silver halide emulsion having finer grains can be used in the red-sensitive layer positioned on (or above) the filter layer compared with the red-sensitive layer below the yellow-filter layer, the graininess of the red-sensitive emulsion layer thus being improved. There is no general way in which the difference in sensitivity between the red-sensitive layers, can be specified, but it should be determined taking into account various factors such as photographic sensitivity of the overall light sensitive material, the stratum structure, the halogen composition of the silver halide, and the kind and amount of emulsion additives such as couplers present when the yellow filter is interposed between two or more red-sensitive layers. However, the sensitivity of the second red-sensitive layer positioned on (or above) the yellow filter layer is preferably about 0.1 to 0.2 times the sensitivity of the first red-sensitive layer positioned below the yellow filter layer. This relationship can be appropriately decided by those skilled in the art based on common knowledge and experience.

The red-sensitive layer positioned on the yellow filter layer is designed so that the cyan density obtained by color-developing the layer becomes preferably not less than about 20%, particlarly preferably not less than 50%, of the total cyan density necessary for the light-sensitive material. Additionally, in this case, known techniques of setting the spectral sensitivity of the light-sensitive layer to the shorter wavelength side can be employed in combination. Furthermore, a red-sensitizing dye can be added to the blue-sensitive layer to sensitize the layer to red light as well. Also, a part of the green-sensitive layer can be positioned on the yellow filter layer. These and other sequences of layers can be selected as desired, for example, as disclosed in commonly assigned U.S. patent application Ser. No. 523,083, filed Nov. 12, 1974 (corresponding to Japanese patent application No. 127,084/73, Japanese OPI 79334/75).

Additionally, the overall yellow density for the yellow filter layer can be separated into two portions, one being shared by the protective layer. In this case, the yellow density shared by the protective layer is not more than about ½ the total yellow density. If the yellow density of the protective layer is increased, the significance of providing the yellow filter layer on the red-sensitive layer becomes extremely small.

Additionally, as to the green-sensitive layer, the blue-sensitive layer not sensitized to red light and the yellow filter when part of the yellow density is not shared by the protective layer, particular modifications (relating to structure, processing, etc.) for conducting the present invention are unnecessary.

It can easily be understood that, since the gist of the present invention lies in positioning all or a part of the red-sensitive layer on the yellow filter layer, photographic emulsions and additives suitable for each layer of the light-sensitive material of the present invention include those compositions and compounds suitable for use in ordinary photographic color light-sensitive materials.

Some examples of suitable additives are illustrated below. For example, well known anti-fogging agents and stabilizers including 4-hydroxy-6-methyl-1,3,3a,7-tetrazaindene can be employed. Specific examples thereof are shown in C. E. K. Mees and T. H. James, *The Theory of the Photographic Process,* 3rd. Ed., p.344 (1966) and the original literature cited therein and in the following patents: U.S. Pat. Nos. 1,758,576, 2,110,178, 2,131,038, 2,173,628, 2,697,040, 2,304,962, 2,324,123, 2,394,198, 2,444,605-8, 2,566,245, 2,694,716, 2,697,099, 2,708,162, 2,728,663-5, 2,746,536, 2,824,001, 2,843,491, 2,886,473, 3,052,544, 3,137,577, 3,220,839, 3,226,231, 3,236,652, 3,251,691, 3,252,799, 3,287,135, 3,326,681, 3,420,668, 3,622,339, British patent Nos. 893,428, 403,789, 1,173,609, 1,200,188.

Examples of suitable chemical sensitizing agents are described in U.S. Pat. Nos. 2,399,083, 2,540,085, 2,597,856, 2,597,915, 2,566,263, 2,598,079, 2,448,060, 2,540,086, 2,566,245, 3,501,313, 1,574,944, 2,410,689. 3,189,458, 2,487,850, 2,518,698, 2,521,925, 2,521,926, 2,694,637, 2,983,610, 3,201,254, etc.

Also, surface active agents can be used alone or in combination. They are used as a coating aid and, in some cases, used for other purposes such as for emulsion dispersion, sensitization, antistatic purposes, adhesion-preventing purposes, etc. Suitable surface active agents include a large number of known compounds including natural surface active agents such as saponin used for photographic purposes. Examples of suitable surface active agents are described in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174, 3,545,974, West German Pat. No. 1,942,665, British Pat. Nos. 1,077,317, 1,198,459, etc.

Similarly an extremely large number of color couplers are known in the art, too. In the present invention, addition of couplers to an emulsion can be effected either by dissolving in an oil for dispersion or by adding couplers in the form of an alkaline aqueous solution.

For example, suitable couplers for the blue-sensitive layer are those described in U.S. Pat. Nos. 2,875,057, 3,265,506, 3,551,155, 3,551,156, commonly assigned U.S. patent application Ser. No. 235,937 filed Mar. 20, 1972, Japanese Patent No. 5582/67, Japanese Patent Laid-Open No. 66836/73, etc. and, suitable couplers for the green-sensitive layer are those described in U.S. Pat. Nos. 2,600,788, 2,983,608, 3,062,653, 3,476,560, British Pat. No. 956,261, Japanese Pat. No. 20636/70, Japanese Patent Laid-Open No. 26133/72, etc. Also, suitable couplers for the red-sensitive layer are those described in U.S. Pat. Nos. 3,591,383, 2,474,293, 2,698,794, 3,034,892, 3,481,714, 3,581,971, etc. In addition, the DIR compounds described in U.S. Pat. Nos. 3,379,529, 3,617,291, 3,705,801, 3,516,831, 3,253,924, 3,311,476, 3,227,554, 3,297,445, German Pat. OLS No. 2,163,811, etc. can also be used.

The green-sensitive layer and the red-sensitive layer can be spectrally sensitized or supersensitized by the individual or combined use of polymethine dyes (e.g., cyanine, merocyanine, carbocyanine or like cyanine dyes), or by the combination thereof with a styryl dye, etc. Furthermore, in order to improve heat desensitization property or increase the intrinsic sensitivity of the blue-sensitive layer, a cyanine dye can be added to the blue-sensitive layer.

These color-sensitizing agents are well known and typical examples thereof are described in e.g., U.S. Pat. Nos. 2,493,748, 2,519,001, 2,977,229, 3,480,434, 3,672,897, 2,688,545, 2,912,329, 3,397,060, 3,511,644, 3,522,052, 3,527,641, 3,615,613, 3,615,632, 3,615,635, 3,617,295, 3,628,964, 3,635,721, British Pat. Nos. 1,195,302, 1,137,580, 1,216,203, 1,242,588, 1,293,862, West German Pat. OLS Nos. 2,030,326, 2,121,780, Japanese Pat. Nos. 4936/68, 14030/69, 10773/68, etc. These sensitizers can be properly selected according to the wavelength region to be sensitized, sensitivity, purpose and end use of the light-sensitive materials.

The binder for the silver halide is a hydrophilic colloid and illustrative examples include, e.g., proteins such as gelatin, colloidal albumin, casein, etc.; cellulose derivatives such as carboxymethyl cellulose, hydroxyethyl cellulose, etc.; polysaccharides such as agar-agar, sodium alginate, starch compounds, etc.; synthetic hydrophilic colloids such as polyvinyl alcohol, poly-N-vinylpyrrolidone, polyacrylic acid copolymers, polyacrylamide or the derivatives or partially hydrolyzed products thereof; and the like. If desired, a compatible mixture of two or more of these colloids can be used. Of these, gelatin is used most generally. However, gelatin can be replaced, partly or completely, by a synthetic high molecular weight substance, by a so-called gelatin derivative (modified by reacting gelatin with a compound having a group capable of reacting with the functional groups contained in the gelatin molecule (i.e., amino groups, imino groups, hydroxy groups or carboxy groups)), or by a graft polymer prepared by grafting a molecular chain of another high molecular weight substance to the gelatin. Suitable branch high polymers to be grafted on gelatin are described in U.S. Pat. Nos. 2,763,625, 2,831,767, 2,956,884, *Polymer Letters,* 5, 595 (1967), *Phot. Sci. Eng.,* 9, 148 (1965), *J. Polymer Sci.,* A-1, 9, 3199 (1971), and the like. Homopolymers or copolymers of those monomers which are generally called vinyl monomers, such as acrylic acid, methacrylic acid, and the ester, amide, and nitrile derivatives thereof, styrene, etc. can widely be used. However, hydrophilic vinyl polymers having some compatibility with gelatin, such as the homopolymers or copolymers of acrylic acid, acrylamide, methacrylamide, hydroxyalkyl acrylate, hydroxyalkyl methacrylate, etc. are particularly preferred. Also, in the photographic emulsion layers and other layers used in the present invention synthetic polymer compounds such as latex-like vinyl compound polymers dispersed in water, compounds capable of increasing, in particular, the dimensional stability of photographic materials, and the like, can be employed; alone or in combination (of different polymers) or in combination with a hydrophilic water-permeable colloid. Suitable polymers are described in, e.g., U.S. Pat. Nos. 2,376,005, 2,739,137, 2,853,457, 3,062,674, 3,411,911, 3,488,708, 3,525,620, 3,635,715, 3,607,290, 3,645,740, British Pat. Nos. 1,186,699, 1,307,373, etc. Of these, the copolymers or homopolymers of monomers selected from the alkyl acrylates, alkyl methacrylates, acrylic acid, methacrylic acid, sulfoalkyl acrylates, sulfoalkyl methacrylates, glycidyl acrylate, glycidyl methacrylate, hydroxyalkyl acrylates, hydroxyalkyl methacrylates, alkoxyalkyl acrylates, alkoxyalkyl methacrylates, styrene, butadiene, vinyl chloride, vinylidene chloride, maleic anhydride and itaconic anhydride are generally used. In some cases, a so-called graft-type emulsion polymerization latex prepared by conducting emulsion polymerization in the copresence of a hydrophilic protective colloid high polymer can be used.

The emulsion can be hardened in a conventional manner. Examples of hardeners, include, for example, aldehyde compounds such as formaldehyde, glutaraldehyde, etc.; ketone compounds such as diacetyl, cyclopentanedione, etc.; compounds having a reactive halogen such as bis(2-chloroethylurea), 2-hydroxy-4,6-dichloro-1,3,5-triazine and those described in U.S. Pat. Nos. 3,288,775, 2,732,303, British Pat. Nos. 974,723, 1,167,207, etc.; reactive olefin compounds such as divinylsulfone, 5-acetyl-1,3-diacryloylhexahydro-1,3,5-triazine, those described in U.S. Pat. Nos. 3,635,718, 3,232,763, British Pat. No. 994,869, etc.; N-methylol compounds such as N-hydroxymethylphthalimide and those described in U.S. Pat. Nos. 2,732,316, 2,586,168, etc.; isocyanates as described in U.S. Pat. Nos. 3,103,437; aziridine compounds as described in U.S. Pat. Nos. 3,017,280, 2,983,611, etc.; acid compounds as described in U.S. Pat. Nos. 2,725,294, 2,725,295, etc.; carbodiimide compounds as described in U.S. Pat. Nos. 3,100,704, etc.; epoxy compounds as described in U.S. Pat. No. 3,091,437, etc.; isoxazole compounds as described in U.S. Pat. Nos. 3,321,313 and 3,543,292; halocarboxyaldehydes such as mucochloric acid, etc.; dioxane compounds such as dihydroxydioxane, dichlorodioxane, etc.; and inorganic hardening agents such as chromium alum, zirconium sulfate, etc. Also, precursors of the above-described compounds such as the alkali metal bisulfite-aldehyde adducts, hydantoin methylol compounds, primary aliphatic nitroalcohols, etc. can be used in place of the above-described compounds.

The photographic emulsion can be coated on a substantially planar substance which does not undergo any serious dimensional change during processing, such as a rigid support (like glass) or a flexible support. Typical flexible supports include a cellulose nitrate film, a cellulose acetate film, a cellulose acetate butyrate film, a cellulose acetate propionate film, a polystyrene film, a polyethylene terephthalate film, a polycarbonate film, a laminate thereof, paper, etc., commonly used for photographic light-sensitive materials. Papers coated or laminated with baryta or an α-olefin polymer, in particular, a polymer of an α-olefin having 2 to 10 carbon atoms such as polyethylene, polypropylene, ethylene-butadiene copolymers, etc., plastic films whose surface has been roughened to improve the intimate adhesive property with other polymer substances and increase the printing characteristics as described in Japanese Pat. No. 19068/72, and the like can provide good results. Of these supports, a transparent or opaque support is selected depending upon the end use of the light-sensitive materials. Also, with transparent supports, not only colorless, transparent supports but transparent supports colored by adding dyes or pigments can be used as well. This coloring of supports has been conducted with X-ray films and is described in *J. SMPTE*, 67, p. 296 (1958) etc.

Opaque supports include essentially opaque supports such as paper and, in addition, those prepared by adding dyes or pigments such as titanium oxide to a transparent film, a plastic film surface-treated according to the method described in Japanese Pat. No. 19068/72, papers or plastic films to which carbon black, a dye or the like has been added to render the support completely light-intercepting, and the like. Where the adhesion between the support and the photographic emulsion layer is insufficient, a layer adhesive to both the support and the photographic emulsion layer as a subbing layer can be provided. Also, in order to improve further the adhesion, the surface of the synthetic resin supports can be subjected to preliminary processings such as corona discharge, irradiation with ultraviolet light, flame treatment, etc.

Each layer can be coated using various coating methods including dip-coating, air-knife coating, and extrusion coating using, for example, the hopper described in U.S. Pat. No. 2,681,294.

In desired, two or more layers can be coated at the same time according to the method described in U.S. Pat. Nos. 2,761,791, 3,508,947, 2,941,898, 3,526,528, etc.

The exposed light-sensitive material of this invention can be color-developed and then bleached and fixed or blixed to form an image.

The light-sensitive material of the present invention can be color development-processed using an aromatic primary amino compound such as a p-phenylenediamine derivative. Typical color developing agents include inorganic acid salts of N,N-diethyl-p-phenylenediamine, 2-amino-5-diethylaminotoluene, 2-amino-5-(N-ethyl-N-laurylamino)toluene, 4-[N-ethyl-N-(β-hydroxyethyl)amino]-aniline, 3-methyl-4-amino-N-ethyl-N-(β-hydroxyethyl)aniline, etc.; 4-amino-3-methyl-N-ethyl-N-(β-methanesulfonamidoethyl)aniline sesquisulfate monohydrate described in U.S. Pat. No. 2,193,015; N-(2-amino-5-diethylaminophenylethyl)methanesulfonamide sulfate as described in U.S. Pat. No. 2,592,364; N,N-dimethyl-p-phenylenediamine hydrochloride; 3-methyl-4-amino-N-ethyl-N-methoxyethylaniline as described in Japanese Patent Laid-Open No. 64933/73; and the like.

These color developing agents are described in detail in, e.g., L. F. A. Mason; *Photographic Processing Chemistry*, pp. 226–229, Focal Press, London, (1966).

Also, these color developing agents can be used in combination with 3-pyrazolidones.

To the color developing solution can be added, if desired, various additives. Typical examples of suitable additives include an alkali agent (e.g., an alkali metal or ammonium hydroxide, carbonate or phosphate), a pH-adjusting or buffering agent (e.g., a weak acid such as acetic acid, boric acid, etc., a weak base, and a salt thereof), a development accelerator (e.g., various pyridinium compounds as described in U.S. Pat. Nos. 2,648,604, 3,671,247, etc., cationic compounds, potassium nitrate, sodium nitrate, polyethylene glycol condensate as described in U.S. Pat. Nos. 2,533,990, 2,577,127, 2,950,970, etc. and derivatives thereof, nonionic compounds such as polythioethers of which the compounds described in British Pat. Nos. 1,020,033 and 1,020,032 are representative, polymers having a sulfate ester group of which the compounds described in U.S. Pat. No. 3,068,097 are representative, organic amines such as pyridine, ethanolamine, etc., benzyl alcohol, hydrazines, and the like), an anti-fogging agent (e.g., an alkali metal bromide, an alkali metal iodide, nitrobenzimidazole as described in U.S. Pat. Nos. 2,496,940 and 2,656,271, mercaptobenzimidazole, 5-methylbenzotriazole, 1-phenyl-5-mercaptotetrazole, antifoggants for a rapid processing solution described in U.S. Pat. Nos. 3,113,864, 3,342,596, 3,295,976, 3,615,522, 3,597,199, etc., thiosulfonyl compounds as described in British Pat. No. 972,211, phenazine-N-oxides as described in Japanese Pat. No. 41675/71, antifogging agents as described in *Scientific Photographic Handbook*, II, pp. 29–47, etc.), stain-or sludge-preventing agents as described in U.S. Pat. No. 3,161,513, 3,161,514, British Pat. Nos. 1,030,442, 1,144,481, and 1,251,558, an interimage effect-accelerating agent as described in U.S. Pat. No. 3,536,487, and a preservative (e.g., a sulfite, a bisulfite, hydroxylamine hydrochloride, formsulfite, an alkanolaminesulfite adduct, etc.).

To a bleaching bath can be added, if desired, a fixing agent so that the bath can be used as a bleach-fixing bath. Many compounds can be used as the bleaching agent. Of these, ferricyanides, dichromate, water-soluble cobalt (III) salts, water-soluble copper (II) salts, water-soluble quinones, nitrosophenols, a complex salt of a multivalent cation such as iron (III), cobalt (III), copper (III), etc. and an organic acid (e.g., a metal salt of ethylenediaminetetraacetic acid, nitrilotriacetic acid, iminodiacetic acid, N-hydroxyethylethylenediaminetriacetic acid or a like aminopolycarboxylic acid, malonic acid, tartaric acid, malic acid, diglycolic acid, dithioglycolic acid, 2,6-dipicolinic acid-copper complex salt; etc.), peracids (e.g., alkylperacids, persulfates, permanganates, hydrogen peroxide, etc.), a hypochlorite, chlorine, bromine, and the like are generally used alone or in suitable combination.

The present invention will now be illustrated in greater detail by reference to the following non-limiting example of a preferred embodiment of the invention. Unless otherwise indicated herein, all parts, percents, ratios and the like are by weight.

EXAMPLE

[Sample A] (Comparative sample corresponding to the stratum structure shown in FIG. 1)

The following emulsion layers were coated, in sequence, on a subbing layer on a support of polyethylene terephthalate.

First Layer (Red-sensitive emulsion layer)

To 1000 g of highly sensitive silver bromoiodide emulsion (halogen composition: 5 mol% iodide) containing 10 g of silver halide and 5 g of gelatin per 100 g was added 100 cc of a 0.06% methanol solution of Sensitizing Dye S-1. Then, 500 g of a gelatin solution having dissolved therein Cyan Coupler C-1 (silver/coupler ratio=7 mols/1 mol), 50 cc of a 1% aqueous solution of Stabilizer A-1, 50 cc of a 1% aqueous solution of Coating Agent T-1 and 20 cc of a 2% aqueous solution of Hardener H-1 were added thereto. The resulting emulsion solution was coated in a dry thickness of 4μ.

Second Layer (Interlayer)

A gelatin solution, prepared by adding 100 g of a gelatin aqueous solution containing emulsified and dispersed therein Color Stain-Preventing Agent A-2, 50 cc of a 1% aqueous solution of Coating Agent T-1 and 20 cc of a 2% aqueous solution of Hardener H-1 to 1000 g of a 5% gelatin aqueous solution, was coated in a dry thickness of 1μ.

Third Layer (Green-sensitive emulsion layer)

To 1000 g of a highly sensitive silver bromoiodide emulsion (halogen composition: 5 mol % iodide) containing 10 g of silver halide and 5 g of gelatin per 100 g was added 100 cc of a 0.1% methanol solution of Sensitizing Dye S-2. Then, 700 g of a gelatin solution containing emulsified and dispersed therein Magenta Coupler C-2 (silver/coupler ratio=7 mols/1 mol), 50 cc of an aqueous solution of Stabilizing Agent A-1, 50 cc of a 1% aqueous solution of Coating Solution T-1 and 20 cc of a 2% aqueous solution of Hardener H-1 were added thereto. The resulting emulsion solution was coated in a dry thickness of 4 μ.

Fourth Layer (Yellow filter layer)

To 1000 g of a 5% gelatin aqueous solution containing dispersed therein colloidal silver were added 100 cc of a 1% aqueous solution of Coating Agent T-1 and a 2% aqueous solution of Hardener H-1. The resulting solution was coated in a silver amount of 0.5 mg/cm$^2$.

Fifth Layer (Blue-sensitive emulsion layer)

To 1000 g of a highly sensitive silver bromoiodide emulsion (halogen composition: 5 mol% iodide) containing 10 g of silver halide and 5 g of gelatin per 100 g were added 500 g of a gelatin solution containing emulsified and dispersed therein Yellow Coupler C-3 (silver/coupler ratio=7 mols/1 mol), 50 cc of a 1% aqueous solution of Stabilizer A-1, 50 cc of a 1% aqueous solution of Coating Agent T-1 and 20 cc of a 2% aqueous solution of Hardener H-1. The resulting emulsion solution was coated in a dry thickness of 4μ.

Sixth Layer (Protective Layer)

A gelatin solution, prepared by adding 100 cc of a 1% aqueous solution of Coating Agent T-1 and 20 cc of a 1% aqueous solution of Hardener H-1 to a 5% gelatin aqueous solution, was coated in a dry thickness of 1μ.

[Sample B] (The relative relationship of each layer corresponds to the structure shown in FIG. 2)

The following emulsion solutions were prepared and coated on the same kind of support as described for Sample A.

First Layer (First red-sensitive emulsion layer)

The same coating solution as in sample A was prepared and coated in a dry thickness of 2μ.

Second Layer (First interlayer)

The same coating solution as used for the second layer of Sample A was prepared and coated in the same manner.

Third Layer (Green-sensitive emulsion layer)

The same coating solution as used for the third layer of Sample A was prepared and coated in the same manner.

Fourth Layer (Yellow filter layer)

The same coating solution as used for the fourth layer of Sample A was prepared and coated in the same manner.

Fifth Layer (Blue-sensitive emulsion layer)

A coating solution as used for the fifth layer of Sample A, except that the highly sensitive silver bromoiodide emulsion used was more sensitive (1.2 times), was prepared and coated in the same manner.

Sixth Layer (Second interlayer)

The same coating solution as used for the second layer of Sample A was prepared and coated in the same manner.

Seventh Layer (Second red-sensitive emulsion layer)

A coating solution as used for the first layer of Sample A except that the sensitivity of the silver bromoiodide emulsion used was low sensitive (1/10 that of the red-sensitive emulsion in Sample A) and that 150 cc of a 0.1% methanol solution of the Sensitizing Dye S-1 was added was prepared and coated in a dry thickness of 2$\mu$.

Eighth Layer (Protective layer)

The same coating solution as used for the sixth layer of Sample A was prepared and coated in the same manner.

[Sample C] (The relative relationship of each layer, corresponds to the structure shown in FIG. 2, wherein the yellow filter was separated into a filter layer and a protective layer)

The following emulsion solutions were prepared and coated on the same kind of support as described for Sample A.

First Layer (First red-sensitive emulsion layer)

The same coating solution as used for the first layer of Sample A was prepared and coated in the same manner.

Second Layer (First interlayer)

The same coating solution as used for the second layer of Sample A was prepared and coated in the same manner.

Third Layer (Green-sensitive emulsion layer)

The same coating solution as used for the third layer of Sample A was prepared and coated in the same manner.

Fourth Layer (Yellow filter layer)

The same coating solution as used for the fourth layer of Sample A was prepared and coated in the same manner.

Fifth Layer (Blue-sensitive emulsion layer)

A coating solution as used for the fifth layer of Sample B except that the highly sensitive silver bromoiodide emulsion used was more sensitive (1.2 times) than that of Sample B was prepared and coated in the same manner.

Sixth Layer (Second interlayer)

The same coating solution as used for the second layer of Sample A was prepared and coated in the same manner.

Seventh Layer (Second red-sensitive emulsion layer)

A coating solution as used for the seventh layer of Sample B except that the low sensitive silver bromoiodide emulsion used was more sensitive (about 1.2 times) than that of Sample B was prepared and coated in the same manner.

Eighth Layer (Protective layer)

The same coating solution as used for the fourth layer of Sample A was prepared and coated in a silver amount of 0.1 mg/100 cm$^2$.

[Sample D] (The relative relationship of each layer corresponds to that shown in FIG. 3)

The following emulsion solutions were prepared and coated on the same kind of support as described in Sample A.

First Layer (Green-sensitive emulsion layer)

The same coating solution as used for the third layer of Sample A was prepared and coated in the same manner.

Second Layer (Yellow filter layer)

The same coating solution as used for the fourth layer of Sample A was prepared and coated in the same manner.

Third Layer (Blue-sensitive emulsion layer)

The same coating solution as used for the fifth layer of Sample C was prepared and coated in the same manner.

Fourth Layer (Interlayer)

The same coating solution as used for the second layer of Sample A was prepared and coated in the same manner.

Fifth Layer (Red-sensitive emulsion layer)

A coating solution as used for the first layer of Sample A except that the silver bromoiodide emulsion used was low sensitive (about $\frac{1}{8}$ that of Sampole A) and that 150 cc of a 0.1% methanol solution of the Sensitizing Dye S—1 was added was prepared and coated in the same manner.

Sixth Layer (Protective layer)

The same coating solution as used for the sixth layer of Sample A was prepared and coated in the same manner.

[Sample E] (The relative relationship of each layer corresponds to that shown in FIG. 3, in which however, the yellow density for yellow filter is shared by the filter layer and the protective layer)

The following emulsion solution were prepared and coated on the same kind of support as described in Sample A.

First Layer (Green-sensitive emulsion layer)

The same coating solution as used for the third layer of Sample A was prepared and coated in the same manner.

Second Layer (Yellow filter layer)

The same coating solution as used for the fourth layer of Sample C was prepared and coated in the same manner.

Third Layer (Blue-sensitive emulsion layer)

A coating solution as used for the third layer of Sample D except that the highly sensitive silver bromoiodide emulsion used was more sensitive (1.2 times) than that of Sample D was prepared and coated in the same manner.

Fourth Layer (Interlayer)

The same coating solution as used for the second layer of Sample A was prepared and coated in the same manner.

Fifth layer (Red-sensitive emulsion layer)

A coating solution as used for the fifth layer of Sample D except that the low sensitive silver bromoiodide emulsion used was more sensitive (1.2 times) than that of Sample D was prepared and coated in the same manner.

Sixth Layer (Protective layer)

The same coating solution as used for the eighth layer of Sample C was prepared and coated in the same manner.

Sensitizing Dye S-1

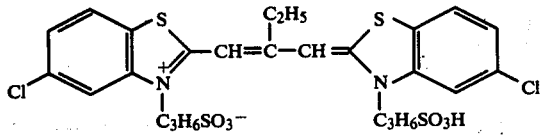

Sensitizing Dye S-2

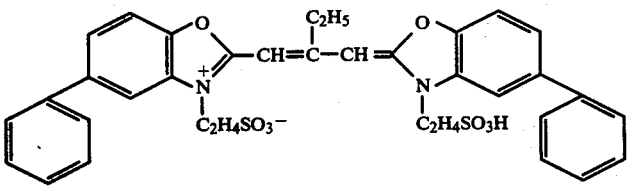

Cyan Coupler C-1

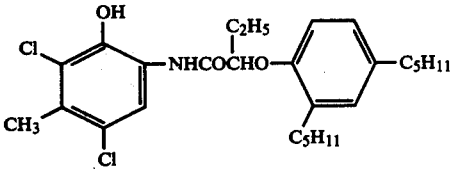

Manner of emulsification: 75 g of Cyan Coupler C-1 was dissolved in a mixture of 100 cc of dibutyl phthalate and 200 cc of ethyl acetate and was emulsified in 600 g of a 10% aqueous solution together with a dispersing aid.

Magenta Coupler C-2

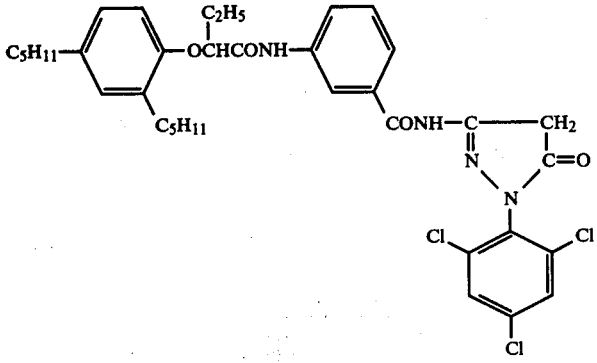

Manner of emulsification: Emulsification was effected in the same manner as with Cyan Coupler C-1 except for dissolving 75 g of Magenta Coupler C-2 in place of Cyan Coupler C-1.

Yellow Coupler C-3

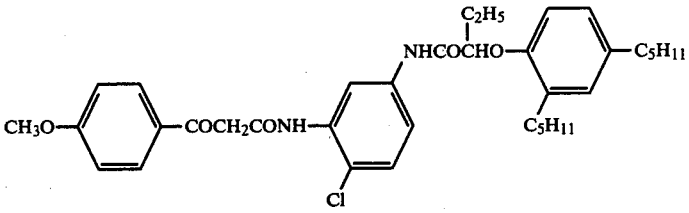

Manner of emulsification: Emulsification was effected in the same manner as with Cyan Coupler C-1 except for dissolving 90 g of Yellow Coupler C-3 in place of Cyan Coupler C-1.

Stabilizer A-1

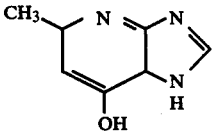

Color Stain Preventing Agent A-2

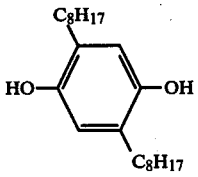

Manner of emulsification: 100 g of Color Stain-Preventing Agent A-2 was dissolved in a mixture of 200 cc of ethyl acetate, and was emulsified into 500 g of a 10% gelatin aqueous solution together with a dispersing aid.

Coating Agent T-1

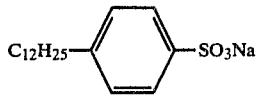

Hardener H-1

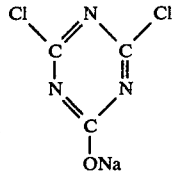

Comparison of the tolerance for light from a fluorescent lamp was conducted as follows. With each sample, sensitometry was conducted two times, once using a tungsten light of a color temperature of 3200° K. as a light source and then using a white fluorescent lamp as a light source, to determine the sensitivity of the RL, GL and BL in terms of the log (exposure amount) at which the red light density, the green light density and the blue light density became 1.0 (hereinafter referred to as "$S_R$ 1.0", "$S_G$ 1.0", and "$S_B$ 1.0", respectively). The relative relationship of the RL and BL based on that of the GL, i.e., "$S_R$ 1.0–$S_G$ 1.0" and "$S_B$ 1.0–$S_G$ 1.0" were represented, respectively, as $\Delta S_R$ and $\Delta S_B$ ($\Delta S_R = S_R$ 1.0–$S_G$ 1.0; $\Delta S_B = 1.0$–$S_G$ 1.0).

The differences between these values obtained by using tungsten light as a light source (hereinafter represented as "$\Delta S_R{}^T$" and "$\Delta S_B{}^T$", respectively) and those obtained by using a white fluorescent lamp as a light source (hereinafter referred to as "$\Delta S_R{}^{FL}$" and "$\Delta S_B{}^T$", respectively) and those obtained by using a white fluorescent lamp as a light source (hereinafter referred to as "$\Delta S_R{}^{FL}$" and "$\Delta S_B{}^{FL}$") (i.e., $\Delta S_R{}^{FL}$–$\Delta S_R{}^T$, $\Delta S_B{}^{FL}$–$\Delta S_R{}^T$) were determined. The nearer these values to zero, the better the tolerance for light from a fluorescent lamp.

Also, comparison of graininess was conducted by determining Root Mean Square (hereinafter abbreviated as RMS) at microscopic density and comparing the RMS value at a density of 1.0 with that at a density of 1.5. The smaller the RMS value, the better the graininess. The RMS values were measured according to the description in M. Takano; *Television,* vol. 23, No. 1, pp. 13–23 (1969). The development was conducted according to the following sequence of steps.

| Processing Step | Temp. | Time |
|---|---|---|
| Hardening | 30° C. | 1 min. |
| Washing | " | 1 |
| First Development | " | 3 |
| Washing | " | 0.5 |
| Reversal Exposure | (uniform exposure of emulsion surface in an exposure amount of 8,000 1x) | |
| Second Development | 30 | 4 |
| Washing | " | 1 |
| Bleaching | " | 1 |
| Washing | " | 0.5 |
| Fixing | " | 1 |
| Washing | " | 1 |

The processing solutions used had the following compositions.

| Hardening Bath | |
|---|---|
| Sulfuric Acid (1:1 by volume with water) | 5.4 ml |
| Sodium Sulfate | 150 g |
| Sodium Acetate | 20 g |
| Formaldehyde (40% aqueous solution) | 10 ml |
| Pyruvic Aldehyde (40% aqueous solution) | 10 ml |
| Water to make the total | 1 liter |

| First Developer | |
|---|---|
| 4-(N-Methylamino)phenol Sulfate | 2 g |
| Sodium Sulfite | 90 g |
| Hydroquinone | 8 g |
| Sodium Carbonate (monohydrate) | 52.5 g |
| Potassium Bromide | 5 g |
| Potassium Thiocyanate | 1 g |
| Water to made the total | 1 liter |

| Second Developer | |
|---|---|
| Benzyl Alcohol | 5 ml |
| Sodium Sulfite | 5 g |
| Hydroxylamine Hydrochloride | 2 g |
| 4-Amino-3-methyl-N-ethyl-N-(β-methanesulfonamido)ethylaniline sesquisulfate monohydrate | 1.5 g |
| Potassium Bromide | 1 g |
| Sodium Tertiary Phosphate | 30 g |
| Sodium Hydroxide | 0.5 g |
| Ethylenediamine (70% aqueous solution) | 7 ml |
| Water to make the total | 1 liter |

| Bleaching Solution | |
|---|---|
| Potassium Ferricyanide | 100 g |
| Sodium Acetate | 40 g |
| Glacial Acetic Acid | 20 ml |
| Potassium Bromide | 30 g |
| Water to make the total | 1 liter |

| Fixing Solution | |
|---|---|
| Sodium Thiosulfate | 150 g |
| Sodium Acetate | 70 g |
| Sodium Sulfite | 10 g |
| Potassium Alum | 20 g |
| Water to make the total | 1 liter |

The $\Delta S_R{}^{FL}$–$\Delta S_R{}^T$, $\Delta S_B{}^{FL}$–$\Delta S_B{}^T$ and RMS values obtained with Samples A to E according to the above-described procedures are as shown in Table 1 below.

Table 1

| Sample | $\Delta S_R{}^{RL} - \Delta S_R{}^T$ | $\Delta S_B{}^{FL} - \Delta S_B{}^T$ | RMS Value (RL) Density 1.0 | RMS Value (RL) Density 1.5 |
|---|---|---|---|---|
| A | 0.24 | −0.09 | 0.065 | 0.089 |
| B | 0.17 | −0.06 | 0.051 | 0.070 |
| C | 0.19 | −0.08 | 0.055 | 0.072 |
| D | 0.10 | −0.06 | 0.040 | 0.056 |

Table 1-continued

| Sample | $\Delta S_R^{RL} - \Delta S_R^T$ | $\Delta S_B^{FL} - \Delta S_B^T$ | RMS Value (RL) Density 1.0 | RMS Value (RL) Density 1.5 |
|---|---|---|---|---|
| E | 0.13 | −0.07 | 0.043 | 0.060 |

As is clear from the results in Table 1, Samples B to E deteriorated markedly less in color balance of the RL and the GL and, at the same time, the graininess of RL was very fine, as compared with Sample A.

While the invention has been described in detail and with reference to specific embodiments thereof, it will be apparent to one skilled in the art that various changes and modifications can be made therein without departing from the spirit and scope thereof.

What is claimed is:

1. A color photographic light-sensitive material comprising a support having coated on one surface thereof at least a first red-sensitized cyan-forming silver halide emulsion layer, at least a green sensitized magenta-forming silver halide emulsion layer, a first yellow filter layer, at least a blue-sensitive silver halide emulsion layer and an uppermost protective layer which optionally functions as a second yellow filter layer which contributes not more than 50 percent of the total yellow filter density, in this order from the support, and a second red-sensitized cyan-forming silver halide emulsion layer which is positioned between the first yellow filter layer and the blue-sensitive silver halide emulsion layer, where the sensitivity of the second red-sensitized silver halide emulsion layer is about 0.1 to 0.2 times the sensitivity of the first red-sensitized silver halide emulsion layer.

2. The light-sensitive material of claim 1 having only one layer which functions as a yellow filter layer which is said first yellow filter layer.

3. The light-sensitive material of claim 1 having both said first and second yellow filter layers.

4. The light-sensitive material of claim 1, wherein said second red-sensitive silver halide emulsion layer provides not less than about 20 percent of the total cyan dye obtained on color development of said light-sensitive material.

5. The light-sensitive material of claim 1 having only one yellow filter layer which is said first yellow filter layer.

6. The light-sensitive material of claim 1, having one layer which functions as a yellow filter layer which is said first yellow filter layer.

7. A color photographic light-sensitive material comprising a support having coated on one surface thereof at least a first red-sensitized cyan-forming silver halide emulsion layer, at least a green sensitized magenta-forming silver halide emulsion layer, a first yellow filter layer, at least a blue-sensitive silver halide emulsion layer and an uppermost protective layer which optionally functions as a second yellow filter layer which contributes not more than 50 percent of the total yellow filter density, in this order from the support, and a second red-sensitized cyan-forming silver halide emulsion layer which is positioned over said blue-sensitive silver halide emulsion layer, where the sensitivity of the second red-sensitized silver halide emulsion layer is about 0.1 to 0.2 times the sensitivity of the first red-sensitized silver halide emulsion layer.

8. The light-sensitive material of claim 7, having only one yellow filter layer which only one yellow filter layer is said first yellow filter layer.

9. The light-sensitive material of claim 7, having both said first and second yellow filter layers.

10. The color photographic light-sensitive material of claim 7, wherein said second red-sensitive silver halide emulsion layer provides not less than about 20% of the total cyan density obtained on color development of said light-sensitive material.

11. The color photographic light-sensitive material of claim 9, wherein said second red-sensitive silver halide emulsion layer provides not less than about 50 percent of the total cyan dye density obtained on color development of said light-sensitive material.

* * * * *